United States Patent [19]

Mulqueen

[11] Patent Number: 4,650,389

[45] Date of Patent: Mar. 17, 1987

[54] MECHANISM AND METHOD FOR POSITIONING A FENDER ON A DOCK VERTICAL WALL

[75] Inventor: Paul J. Mulqueen, Cudahy, Wis.

[73] Assignee: Edward E. Gillen Company, Milwaukee, Wis.

[21] Appl. No.: 713,326

[22] Filed: Mar. 18, 1985

[51] Int. Cl.[4] ..... B66F 11/00

[52] U.S. Cl. ..... 414/10; 52/125.3; 114/219; 405/211; 414/694; 414/729; 414/743; 414/908

[58] Field of Search ..... 414/10, 11, 12, 589, 414/590, 607, 618, 620, 680, 694, 705, 723, 729, 743, 908; 114/219; 294/81.1, 81.5, 89; 405/17, 211, 212, 215, 277, 278, 281; 52/125.2, 125.3, 747, 749; 182/2

[56] References Cited

U.S. PATENT DOCUMENTS

| | | | |
|---|---|---|---|
| 2,969,884 | 1/1961 | Salmi | 52/125.3 X |
| 3,598,263 | 8/1971 | Ehmke | 414/620 |
| 3,834,566 | 9/1974 | Hilfiker | 414/694 |
| 3,948,500 | 4/1976 | Korbuly et al. | 114/219 X |
| 4,143,782 | 3/1979 | Dengler | 414/620 X |
| 4,280,785 | 7/1981 | Albrecht | 414/10 X |
| 4,314,622 | 2/1982 | Lindquist | 182/2 |
| 4,365,926 | 12/1982 | Brown | 414/694 X |
| 4,480,942 | 11/1984 | Farrow | 414/694 X |

*Primary Examiner*—Leslie J. Paperner

*Attorney, Agent, or Firm*—Michael, Best & Friedrich

[57] ABSTRACT

A mechanism for positioning on a dock vertical wall a fender including spaced openings, the mechanism comprising a movable support, a first arm pivotally attached to the movable support, a first hydraulic cylinder piston rod assembly for pivoting the first arm, a second arm pivotally attached to the first arm, means for pivoting said second arm, a plurality of spaced projections attached to and extending from the second arm, and pins for releasably securing the projections in the spaced openings in the fender. And a method for positioning on a dock vertical wall fenders including spaced openings opposite an attaching surface, the method comprising the steps of positioning the fender so the spaced openings are accessible, releasably fastening a fender moving mechanism in the openings, locating the fender so the attaching surface is generally vertical, locating the fender on the dock vertical wall, attaching the fender attaching surface to the dock vertical wall, and releasing the fender moving mechanism.

4 Claims, 3 Drawing Figures

MECHANISM AND METHOD FOR POSITIONING A FENDER ON A DOCK VERTICAL WALL

BACKGROUND AND SUMMARY OF THE INVENTION

This invention relates to mechanisms and methods provided for positioning fenders on dock vertical walls.

This invention provides a mechanism for positioning on a dock vertical wall a fender including spaced openings. The mechanism comprises a movable support, a first arm pivotally attached to the movable support, means for pivoting the first arm, a second arm pivotally attached to the first arm, means for pivoting the second arm, a plurality of spaced projections attached to and extending from the second arm, and means for releasably securing the projections in the spaced openings in the fender.

In one embodiment, the mechanism further includes a third arm pivotally attached to the second arm, and means for pivoting the third arm, and the spaced projections are attached to the third arm.

This invention also provides an attachment for a back hoe, the attachment comprising a plate including a first end and a second end, a pair of spaced projections between the first end and the second end and extending from the plate in one direction, and a third projection midway between the first and the second projections and extending from the plate in a direction opposite the one direction, and adapted to be connected to the back hoe.

This invention also provides a method for positioning on a dock vertical wall a fender including spaced openings opposite an attaching surface, the method comprising the steps of positioning the fender so the spaced openings are accessible, releasably fastening fender moving means in the openings, locating the fender so the attaching surface is generally vertical, locating the fender on the dock vertical wall, attaching the fender attaching surface to the dock vertical wall, and releasing the fender moving means.

One of the principal features of the invention is the provision of a convenient mechanism and method for positioning a fender on a dock vertical wall.

Other features and advantages of the invention will become apparent upon reviewing the following description, the drawings, and the appended claims.

Figure 1:
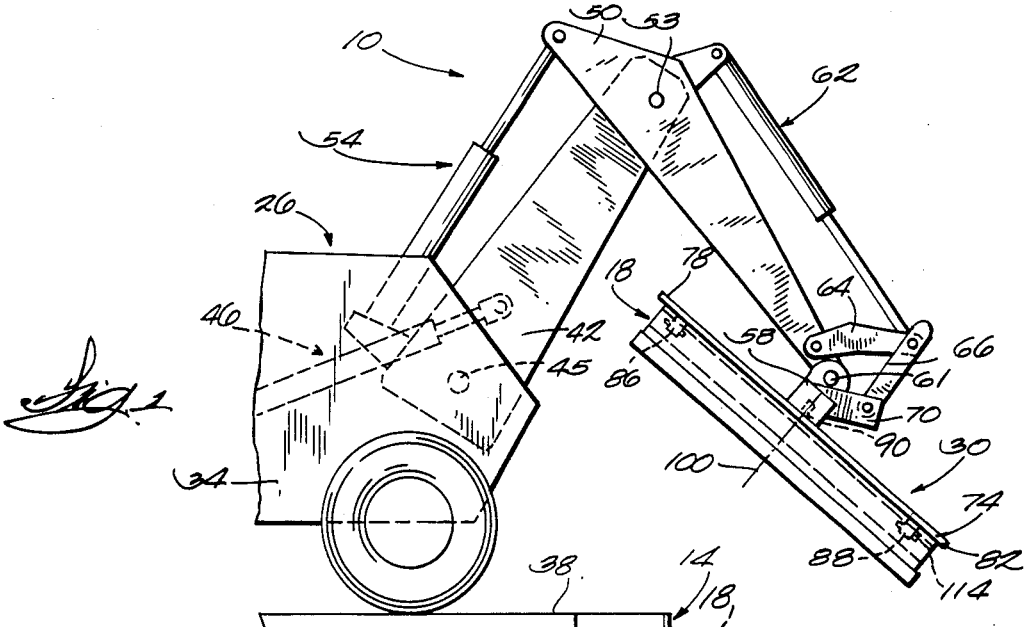
FIG. 1 is a schematic representation of a back hoe including an attachment which is connected to a fender and which embodies various of the features of the invention.

Before explaining the invention in detail, it is to be understood that the invention is not limited in its application to the details of the construction and the arrangement of components set forth in the following description or illustrated in the drawings. The invention is capable of other embodiments and of being practiced and carried out in various ways. It is also to be understood that the phraseology and terminology employed herein is for the purpose of description and not of limitation.

DESCRIPTION OF THE PREFERRED EMBODIMENT

Figure 3:
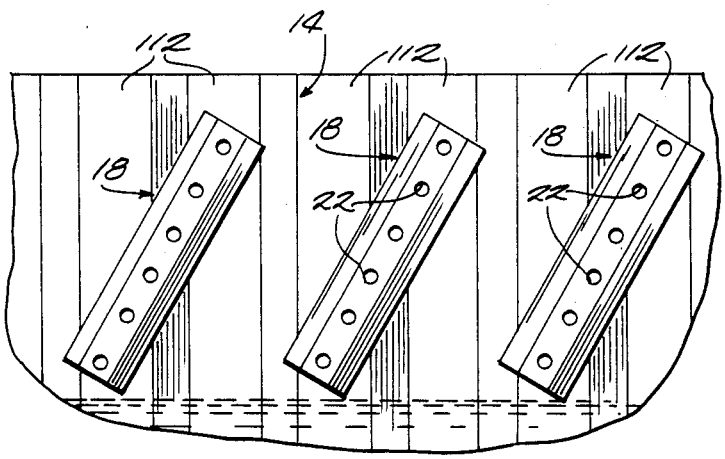
FIG. 3 is a plane view of fenders attached to a dock vertical wall.

Illustrated in the drawings is a mechanism 10 for positioning on a dock vertical wall 14 a fender 18 including a plurality of spaced openings 22 (see FIG. 3). More particularly, as illustrated in FIG. 1, the mechanism 10 comprises a back hoe 26 and an attachment 30 for the back hoe 26. The back hoe 26 comprises a support 34 movable along a dock horizontal surface 38, a first arm 42 pivotally attached to the movable support 34 and pivotable about a first axis 45, and means for pivoting the first arm 42 in the form of a first hydraulic cylinder-piston rod assembly 46 connected between the support 34 and the first arm 42. Means (not shown) is provided for selectively extending and retracting the first hydraulic cylinder-piston rod assembly 46 to pivot the first arm 42.

The back hoe 26 further includes a second arm 50 pivotally attached to the first arm 42 and pivotable about a second axis 53 parallel to the first axis 45, and means for pivoting the second arm 50 in the form of a second hydraulic cylinder-piston rod assembly 54 connected between the first arm 42 and the second arm 50. Means (not shown) is also provided for selectively extending and retracting the second hydraulic cylinder-piston rod assembly 54 to pivot the second arm 50.

The back hoe 26 further includes a third arm 58 pivotally attached to the second arm 50 and pivotable about a third axis 61 parallel to the second axis 53, and means for pivoting the third arm 58 in the form of a third hydraulic cylinder-piston rod assembly 62 connected to the second arm 50 and to the third arm 58 though a link arrangement. More particularly, the link arrangement includes a support link 64 pivotally connected to the second arm 50 and the third cylinder piston rod assembly 62, a first link 66 pivotally connected to the third cylinder-piston rod assembly 62, and a second link 70 pivotally connected to the first link 66 and fixedly connected to the third arm 58. Means (not shown) is also provided for selectively extending and retracting the third hydraulic cylinder-piston rod assembly 62 to pivot the third arm 58.

Figure 2:
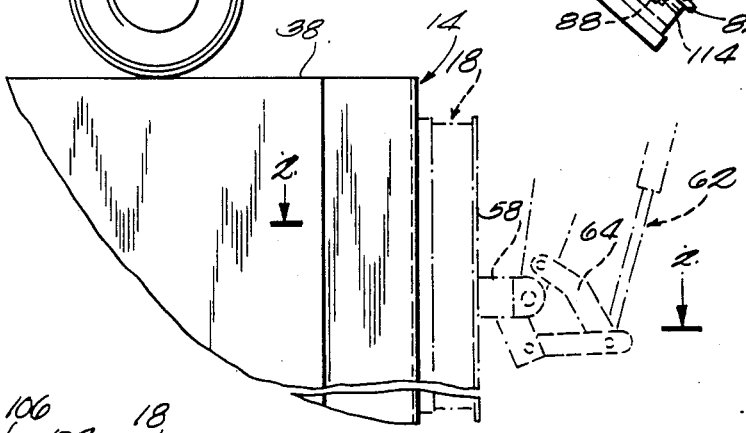
FIG. 2 is a cross-sectional view, partially broken away, taken along the line 2—2 in FIG. 1.
Figure 2:
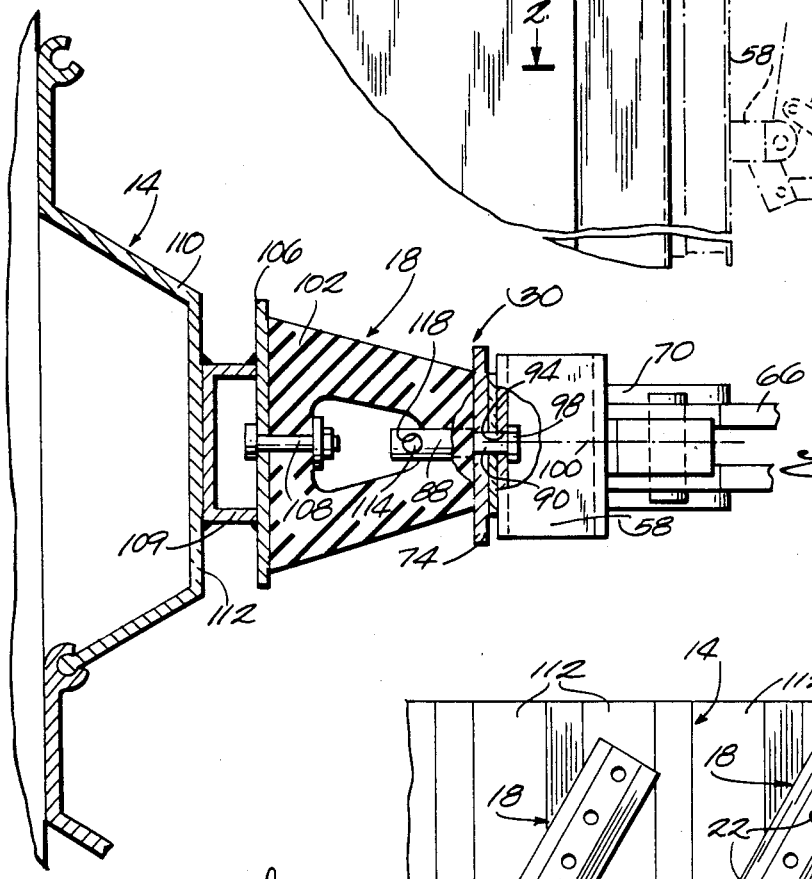

As illustrated in FIG. 1, the attachment 30 for the back hoe 26 comprises a plate 74 including a first end 78 and a second end 82, and first and second spaced projections 86 and 88, respectively, which are located between the first end 78 and the second end 82 and which extend generally perpendicularly from the plate 74 in one direction. The attachment 30 also includes a third projection 90 midway between the first and second projections 86 and 88, respectively and extending from the plate 74 in a direction opposite the one direction. The third projection 90 is adapted to be connected to the back hoe 26. More particularly, as illustrated in FIG. 2, the third projection 90 constitutes a stud which, in part, is threaded, and which is releasably securable in an opening 94 centered in the back hoe third arm 58 by means in the form of nut 98 threaded on the end of the stud 90. The stud 90 is thus rotatable relative to the third arm 58 so that the attachment 30 can pivot relative to the third arm 58 about an axis 100 which is defined by the stud 90 and which is generally perpendicular to the third axis 61.

As illustrated in FIGS. 1, 2 and 3, the fender 18 comprises an elongated rubber member 102, and a rear attachment surface in the form of a metal plate 106 that facilitates attachment of the fender 18 to the dock vertical wall 14. The metal plate 106 is connected to the rubber member 102 by a plurality of nut and bolt assemblies 108 (only one shown) spaced along the elongated member 102, and an elongated channel 109 is welded to the metal plate 106 to facilitate connection of the fender 18 to the wall 14. More particularly, as illustrated in FIG. 2, the fender 18 has a transverse cross-section which is trapezoidal in shape. The fender 18 also has a hollow interior and access to the interior of the fender 18 is possible from the ends of the fender 18.

The dock vertical wall 14 includes metal facing 110 including a raised portion 112 which extends vertically and the fender plate 106 is welded to the metal facing 110 to attach the fender 18 to the dock vertical wall 14. When connected to the dock vertical wall 14, the fender 18 protects boats coming into contact with the dock vertical wall 14 from damaging the wall 14 and the boat.

The plurality of spaced openings 22 extend along the narrow surface of the fender 18. The first and second projections 86 and 88, respectively, extending from the attachment plate 70 are releasably securable in the spaced openings 22 in the fender 18 by means in the form of pins 114 releasably held in cross bores or apertures 118 in the free ends of the first and second projections 86 and 88, respectively.

The fender 18 is positioned in the appropriate location on the dock vertical wall 14 by the following method. The fender 18 is positioned on the dock horizontal surface 38 so that the spaced openings 22 are accessible from above the fender 18. The back hoe 26 is positioned so that the attachment 30 can be lowered and the first and second projections 86 and 88, respectively, received in the spaced openings 22 in the fender 18. The pins 114 are then secured in the aperatures 118 so that the first and second projections 86 and 88, respectively, are releasably secured in the fender 18. The fender 18 is then lifted by the back hoe 26 and rotated by pivoting the third arm 58 relative to the second arm 50 so that the fender plate 106 is generally vertical. The fender 18 is then pivoted about the axis 100 defined by the stud 90 to assume any desired angle for attachment to the dock vertical wall 14 (see FIG. 3), and then lowered along the dock vertical wall 14 and located and temporarily held in its appropriate position. The fender plate channel 109 is then welded to each of the raised portions 112 of the metal facing 110. The pins 114 are then removed from the aperatures 118 and the first and second projections 86 and 88, respectively, are then removed from the fender 18. Although other constructions can be employed in other embodiments, a plurality of fenders 18 are welded to the vertical wall 14 in spaced parallel relationship.

Various features of the invention are set forth in the following claims.

I claim:

1. A mechanism for positioning on a dock vertical wall a fender including spaced openings, said mechanism comprising a movable support, a first arm pivotally attached to said movable support, means for pivoting said first arm, a second arm pivotally attached to said first arm, means for pivoting said second arm, a plurality of spaced projections attached to and extending from said second arm, and means for releasably securing said projections in the spaced openings in the fender.

2. A mechanism in accordance with claim 1 wherein said first arm is pivotable relative to said movable support about a first axis, and said second arm is pivotable relative to said first arm about a second axis parallel to said first axis, and said plurality of spaced projections extend generally perpendicularly to said first and said second axes.

3. A mechanism in accordance with claim 2 and further including a third arm pivotally attached to said second arm, and means for pivoting said third arm, and wherein said spaced projections are attached to said third arm.

4. A mechanism in accordance with claim 3 wherein said third arm is pivotable relative to said second arm about a third axis parallel to said first and said second axes.

* * * * *